US006710690B2

(12) United States Patent
Shiga et al.

(10) Patent No.: US 6,710,690 B2
(45) Date of Patent: Mar. 23, 2004

(54) MAGNET SWITCH FOR STARTER

(75) Inventors: Tsutomu Shiga, Nukata-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 2 days.

(21) Appl. No.: 10/401,575

(22) Filed: Mar. 31, 2003

(65) Prior Publication Data

US 2003/0193382 A1 Oct. 16, 2003

(30) Foreign Application Priority Data

Apr. 12, 2002 (JP) ..... 2002-110296

(51) Int. Cl.[7] ..... H01H 67/02
(52) U.S. Cl. ..... 335/131
(58) Field of Search ..... 335/126, 131, 335/132, 255, 270, 279

(56) References Cited

U.S. PATENT DOCUMENTS 4,382,242 A * 5/1983 Colvin et al. ..... 335/202
5,014,027 A * 5/1991 Ootsuka ..... 333/132
5,525,947 A 6/1996 Shiga et al. ..... 335/126
6,286,378 B1 * 9/2001 Kamei et al. ..... 74/7 A

* cited by examiner

*Primary Examiner*—Ramon M Barrera
(74) *Attorney, Agent, or Firm*—Oliff & Berridge, PLC

(57) ABSTRACT

A magnet switch has a coil of a reduced size and a sufficiently large contact and does not have a rod running through the plunger or the fixed iron core. A flange and a joint are fixed at one end of the plunger. The arm of the flange is connected to a holder via an elastic body. Movable contacts are pushed into the holder to be fixed at one end thereof. When the plunger moves, the flange, the holder, and the movable contacts move somewhat simultaneously to work as a switch.

10 Claims, 3 Drawing Sheets

MAGNET SWITCH FOR STARTER

CROSS REFERENCE TO RELATED APPLICATIONS

This application is based upon, claims the benefit of priority of, and incorporates by reference, the contents of Japanese Patent Applications No. 2002-110296 filed Apr. 12, 2002.

BACKGROUND OF THE INVENTION

1. Field of the Invention

The present invention relates to a starter motor for starting internal combustion engines, and particularly to an improved magnet switch for use in such a starter motor.

2. Description of the Related Art

There is a need for a variety of improvements in starter motors to reduce harmful impacts on the environment. For example, engine starter motors should be lighter and more compact, and have greater durability to maintain or withstand frequent engine idling stops (what is called "eco-run"). Japanese Patent Laid-Open Publication No. Hei 9-68142 discloses a technique that reduces damage on the involved gears by ensuring enhanced gear engagement and lowering the current in the switch in order to reduce the size of the switch itself. More specifically, the current in the attraction switch has been reduced by more than 70%, the attraction coil has been downsized significantly, the ON and OFF switching of the main current and engagement with the ring gear of the pinion are performed with a plunger situated through the center of the coil, a rod moves together with the plunger shaft, and a movable contact and a hook are used for starting the engine. Some of the switches move the movable contact and the hook independently of the two separate rods, but because they move somewhat simultaneously while driven by an attraction force, the operation mechanism is common.

Although the improved engagement made the switch smaller, the electronic current that intermittently runs in the contact thereof does not change because it is determined by the necessary motor power. Consequently, since the current of the same magnitude runs the switch contact, the current density increases, and the contact is likely to wear at an anomalous rate. Moreover, since a thin rod must hold the contact and the hook (joint) at each end, the weight ratio of the contact and the hook grows, and the rod operation is affected by an increased load from the relatively heavy contact and hook. In addition, the sliding gap between the plunger and the inner circumference of the coil leads to instability in operation and results in such problems.

Meanwhile, although the thin rod (its diameter is approximately 2 mm) has to hold a small contact via an insulator washer for electric isolation, the insulator washer of poor mechanical strength often breaks during operation. In general, a contact current of about 700 A runs in the contact. Thus such a break-up of the insulator causes an absence of a safety gap, because the thickness of the insulator is 1 mm or less. Further, when the shock of the pinion engagement reaches the plunger and the contact via the hook, the thin, small rod contact and insulator are likely to break. To solve such problems, the contact may be maintained as large as before. However, this makes the thin rod have a large contact, and its operation becomes unstable. Specifically, the contact chatter by ON and OFF switching produces electric arks and may fuse the contact. Furthermore, as long as the rod exists inside the plunger, the saving of copper used in the coil is limited.

Since the plunger has key components (contact and hook) at both ends, both ends of the rod must be disposed outside the switch through the attraction coil thereof. Then the rod must be made of a non-magnetic material to utilize the magnet force of the coil. This non-magnetic material is usually an expensive material such as stainless steel or copper, which results in an expensive switch. Because the plunger must be assembled from the magnetic and non-magnetic parts in the small space in the attraction coil, the production cost becomes higher. If the rod is made of a magnetic material, all the magnetic flux runs in the rod, and the air gap does not have a magnetic flux. Then, no force to decrease the air gap is produced and the switch does not work.

SUMMARY OF THE INVENTION

To solve the above problems, an object of the present invention is to provide an inexpensive, reliable, compact switch which does not require special materials. The switch will not have a rod running through the plunger and fixed iron core while the contact and the hook are moved, not inside, but outside the attraction coil to reduce the size of the coil and maintain a sufficiently large contact.

In the magnet switch according to a first aspect of the present invention, the attraction coil has a plunger alone in its center, and this plunger is allowed to slide toward the side opposite to a fixed iron core. Thus it becomes possible to eliminate the non-magnetic rod from penetrating the fixed iron core, and the entire structure that forms a magnetic circuit can be made of iron. As a result, the inner circumference of the coil can be made small, and the plunger can also be made thin at no additional cost. Because the contact and the hook are formed on a thick plunger, instead of a thin rod, and the sliding gap between the rod and the plunger or fixed iron core becomes unnecessary, the operation of the contact is stable.

In the magnet switch according to a second aspect of the invention, the contact for current ON and OFF control is formed at one end of the switch, while the joint that drives the pinion is formed at the other end thereof, and they are connected to each other by a flange formed on the outer periphery of the case. Unlike the conventional thin rod, this flange interferes with nothing, so it can be made thick to be sufficiently strong. Then the flange can be large enough in terms of electrical and mechanical requirements with no need to enlarge the switch including an attraction coil and other parts.

In the magnet switch according to a third aspect of the invention, the contact holder is fixed via the flange arm extending from the outer periphery of the case. Thus even a large contact can be fixed with the holder from the outer periphery with a sufficient margin. If the holder is made of an electric insulator, the mechanical strength can be held high and the contact can securely work.

In the magnet switch according to a fourth aspect of the invention, the switch itself is firmly fixed in the starter, and the sliding unit such as the joint and the flange are covered with a cover that covers the contact room. Thus there is no need to add a separate dust cover or enlarge the outer diameter of the switch. Specifically, if the switch of the invention is installed in a usual starter, a separate large cover becomes necessary and its outer diameter becomes as large as the conventional switch. However, the structure of the invention is free from such drawbacks and is compact and durable against dust and water.

The magnet switch according to a fifth aspect of the invention is highly reliable and can be reduced in size.

Engagement control makes the attraction coil current significantly small and permits a reduction in the size of the switch, while reducing production costs.

In the magnet switch according to a sixth aspect of the invention, the center of the attraction coil is made of a fixed iron core alone, and any non-magnetic rod penetrating the fixed iron core is not necessary. Additionally, all the parts can be made of iron to form a magnetic circuit. Thus, the inner circumference of the coil can be made thin, and as a result, the attraction coil can be made small and there is no substantial increase in costs. Because the contact and the hook are formed on a thick plunger, instead of a thin rod, and no sliding gap exists between the rod and the plunger or the fixed iron core, the operation of the contact is not affected. Moreover, since the magnetic circuit of the sliding unit of the plunger and case sidewalls is not the inner circumference of the case sidewalls as in a conventional case, but rather the outer circumference, the operation area becomes large, and accordingly the magnetic resistance becomes smaller. Because of this, the coil can be made smaller.

In the magnet switch according to a seventh aspect of the invention, the contact for current ON and OFF control is formed at one end of the switch, while the joint that drives the pinion is formed at the other end thereof, and they are connected to each other by a flange formed on the outer periphery of the case. Unlike the conventional thin rod, this flange interferes with nothing, therefore it can be made thick to be sufficiently strong. Then the flange can be large enough in terms of electrical and mechanical requirements with no need to enlarge the switch including an attraction coil and other parts.

In the magnet switch according to an eighth aspect of the invention, the contact holder is fixed via the flange arm extending from the outer periphery of the case. Thus even a large contact can be fixed with the holder from the outer periphery with a sufficient margin. If the holder is made of an electric insulator, the mechanical strength can be held high and the contact can securely work.

In the magnet switch according to a ninth aspect of the invention, the switch itself is firmly fixed in the starter, and the sliding unit, that is, the joint and the flange, are covered with a cover covering the contact room. Thus there is no need to add a separate dust cover or enlarge the outer diameter of the switch. Specifically, if the switch of the invention is installed in a usual starter, a separate large cover becomes necessary and its outer diameter becomes as large as the conventional switch. However, the structure of the invention is free from such drawbacks, is compact and durable against dust and water.

The magnet switch according to a tenth aspect of the invention is highly reliable, small in size, and can be made at a reduced cost. Engagement control makes the attraction coil current significantly small, which permits a reduction of the switch size.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENT

Figure 1:
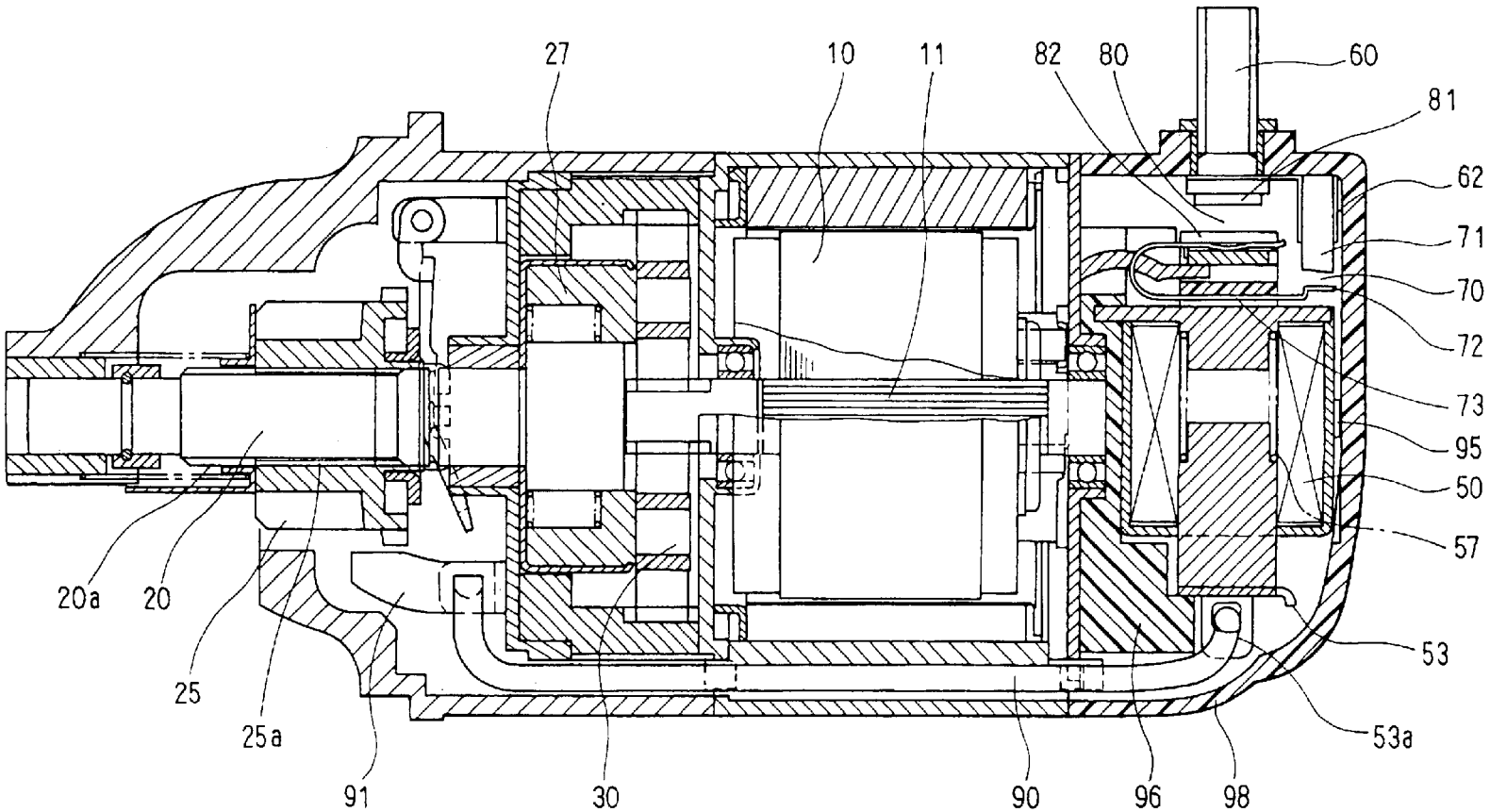
FIG. 1 is a cross-sectional view of the starter of a first embodiment of the invention.
Figure 2:
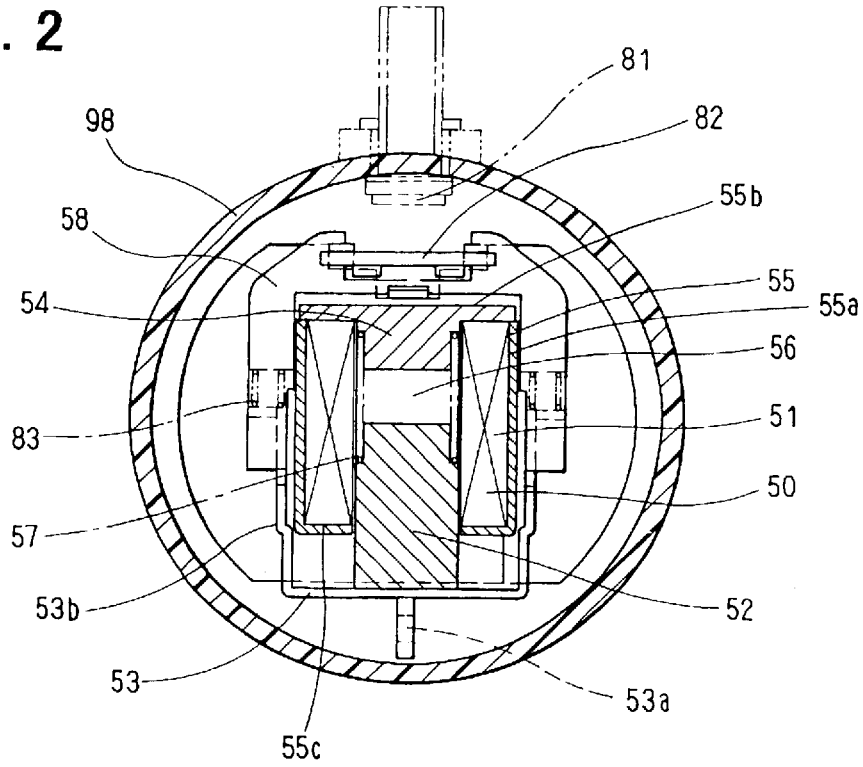
FIG. 2 is a cross-sectional view of the switch of FIG. 1.
Figure 3:
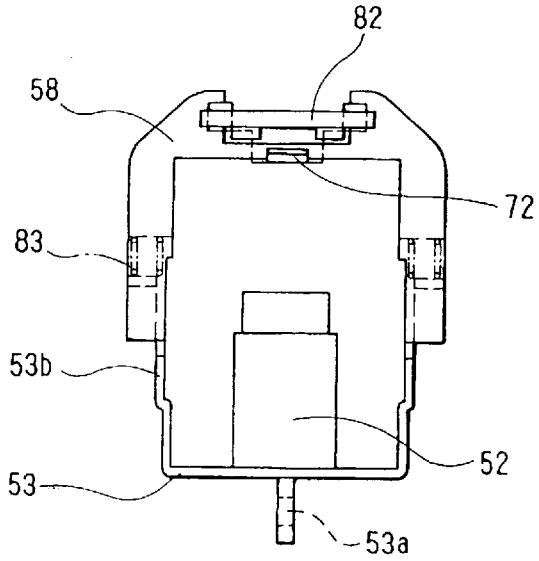
FIG. 3 is an enlarged diagram of the movable portion of the switch of FIG. 1.

Now the starter switch of the invention will be described with reference to a first embodiment shown in FIGS. 1, 2 and 3.

A switch 50 has an attraction coil 51 that generates electromagnetic force, a plunger 52 that forms a magnetic circuit, a case 55, a fixed iron core 54, and an air gap 56 between the plunger 52 and the fixed iron core 54. The case 55 includes a cylindrical part 55*a* and side walls 55*b*, 55*c*, constituting the fixed part of the switch covering the attraction coil 51 together with the fixed iron core 54. The cylindrical part 55*a*, side walls 55*b*, 55*c* of the case 55, and the fixed iron core 54 may be either separated or integrated, as long as they can form a magnetic circuit (in the figure, the side wall 55*b* and fixed iron core 54 are made in one piece).

A first contact 70 is composed of a fixed contact 71 and a movable contact 72. The movable contact 72 forms part of a first elastic body 73 made of a conductive, mechanically strong material such as phosphor bronze.

A second contact 80 is composed of a fixed contact 81 and a movable contact 82. The first and second contacts 70, 80 form a parallel circuit between the battery and the motor. The fixed contact 71 of the first contact 70 made of carbon functions as a resistor in the circuit. The movable contacts 72, 82 are provided with contact pressure against the fixed contacts 71, 81 respectively, by the first and second elastic bodies 73, 83 (two pieces in the figure). In the present embodiment, the elastic bodies 73, 83 are installed in the movable unit that moves together with the plunger. However, they may be installed on the fixed contact 71, 81 sides or installed in a cross. The first fixed contact 71 is connected to a battery via the holder 62, while the second fixed contact 81 is connected to the battery (not shown) directly with a terminal 60.

At one end of the plunger 52, a flange 53 and a joint 53*a* are fixed. An arm 53*b* of the flange 53 is connected to a holder 58 via the second elastic body 83. At the end of the holder 58, the movable contacts 72, 82 are fixed by an appropriate method such as a press fit by simply pushing the movable contacts 72, 82. Thus when the plunger 52 moves, the flange 53, holder 58, movable contacts 72, 82 also move almost together to work as a switch as a whole.

The joint 53*a* has a hole where an end of a connection means 90 is to be inserted. The other end of the connection means 90 is to restrict the rotation of the pinion 25 via a component 91. Specifically, when the attraction coil 51 works to pull the plunger 52, the air gap 56 becomes shorter, and the component 91 contacts, via the connection means, the pinion 25 to restrict its rotation. When the motor is activated under this condition, the pinion 25 moves in the axial direction guided by helical splines 20*a*, 25*a* formed in the outer periphery of the output shaft 20 and the inner circumference of the pinion 25, respectively, and then engages with the ring gear (not shown) of the engine. The shaft 11 of the motor armature 10 is connected to the output shaft 20 via a gear reduction mechanism 30 and a clutch 27.

A return spring 57 pulls the plunger 52 back to its original position when the attraction coil 51 is deactivated. In the present embodiment, the return spring 57 is inserted in the plunger 52, which housed in the magnet switch 50. However, it may be placed anywhere as long as it causes the return of the plunger 52 to its original position. The inner circumference of the attraction coil 51 can be a bearing for the sliding plunger if a sleeve (not shown) made of a thin metal plate (for example, copper) is inserted therein.

A plate spring band 95 fastens the switch onto a seat 96, covering the cylindrical part 55*a* of the case 55 with its elasticity. A cover 98 covers the switch 50 and the contacts 71, 81.

Now the operation of the present invention will be described. When the key switch of the vehicle (not shown) is turned ON, the attraction coil 51 exerts an electromagnetic force to the plunger 52 so that it moves against the return spring 57 to shorten the air gap 56. Then, this motion via the connection means 90 restricts the rotation of the pinion 25. Next, as the first contact 70 connects to the resistor 91 (the carbon-based fixed contact 71 also serves as a resistor in the embodiment), the motor rotates very slowly. Then, while the output shaft 20 rotates, the rotation of the pinion 25 is restricted, and the pinion 25 moves along the axial direction guided by the splines 20*a*, 25*a*, and engages with the ring gear (not shown).

When the plunger 52 moves further, the second contact 80 is closed. Since the first and second contacts form a parallel circuit and the first contact 70 has a resistor, the electric current runs dominantly in the second contact circuit and the motor works to activate the engine. Meanwhile, when the engine has been activated and the key switch has been turned OFF, the attraction coil 51 loses electromagnetic force. Then, the elastic force of the return spring 57 pulls the plunger 52 back, and the second contact 80 is opened. Then a current limited by the resistor 91 is provided to the motor. When the plunger 52 is pulled back further, the first contact 70 is also opened. Because the operations of the engaging parts other than the switch are similar to those disclosed in Japanese Patent Laid-Open Publication No. Hei 10-115274, their explanation is not repeated here.

Because the present invention has no rod penetrating through the attraction coil in the axial direction, the plunger can be made thin and the coil can be made small. The switch has a substantially cylindrical shape with a bottom, and has a structure where the contact and joint move together with the plunger in one end of the switch. As a result, the rod can be eliminated in the sliding gap, and the mechanical structure becomes stable with less play. Since the contact is fastened, with its outer circumference being fixed by the outer periphery of the switch, the holder may have sufficiently large dimensions and therefore its mechanical strength can be ensured even when the holder is made of a resin. Overall, the switch is compact. Furthermore, the sliding part works also as the switch cover, eliminating additional components. Then, combined with the engaging mechanism of the pinion rotation restricting method, the present invention can provide a compact, reliable starter at a low cost. Although a two-stage operation using two contacts is described in this embodiment, this invention can be applied to one-stage operation type switches having a single contact.

(Second Embodiment)

Figure 4:
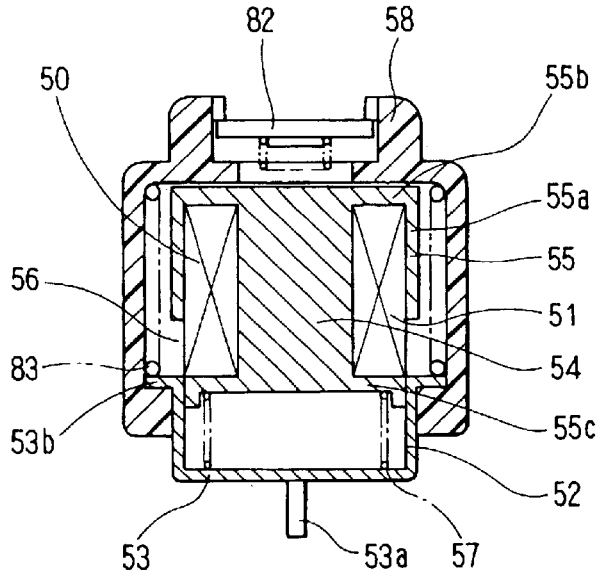
FIG. 4 is a cross-sectional view of the switch of a second embodiment of the invention.
Figure 5:
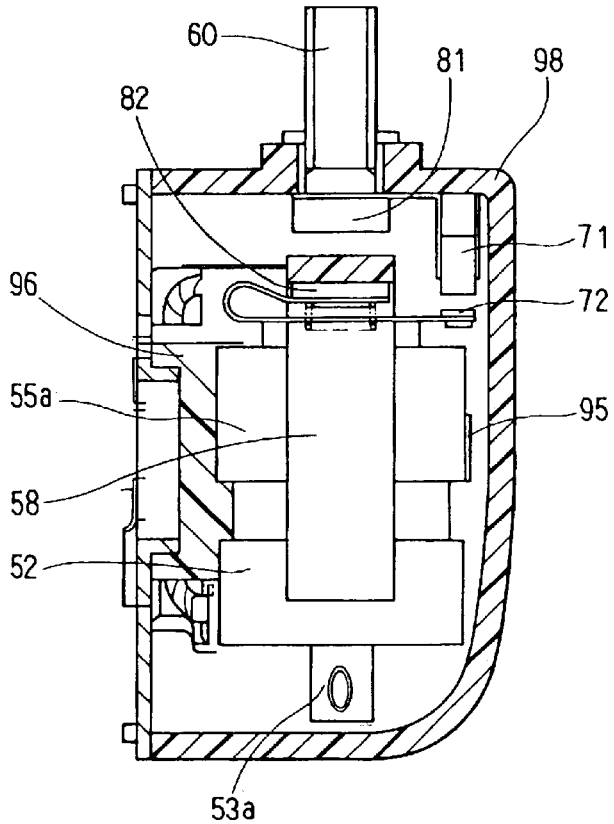
FIG. 5 is a partial cross-sectional view of the starter where the switch of FIG. 4 is installed.

Next, a second embodiment will be described below with reference to FIGS. 4 and 5. The fixed iron core 54 has sidewalls 55*b*, 55*c* on its side faces, and in combination with the cylindrical part 55*a* of the case they form a fixed part of the magnetic circuit for the switch. The plunger 52 has a cylindrical shape and a flange 53 at one end and an arm 53*b* at the other end in one piece. The plunger 52 is pulled by the magnetic force of the attraction coil 51 and shortens the air gap 56 so as to close the contact and cause engagement with the pinion. A return spring 57 and an elastic body 83 provide contact pressure. The other parts and their operations are the same as those of the first embodiment, so their explanation is not repeated here. The present invention can thereby provide a reliable, compact switch at a low cost.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A magnet switch for a starter, for providing an electric current to a starter motor, the magnet switch comprising:

an attraction coil of a substantially cylindrical shape;

a case, wherein the case covers an outer face and a side face of the attraction coil, a fixed iron core, wherein one end of the case's inner structure is closed with the fixed iron core, and wherein the attraction coil, the case, and the fixed iron core are of a substantially cylindrical shape having a closed bottom;

a plunger and the fixed iron core define an air gap, wherein the plunger is disposed within an inner circumference of the attraction coil, and the case, the fixed iron core, the plunger, and the air gap form a magnetic circuit, and the plunger can move to an opposite side of the fixed iron core, pulled by the attraction coil to shorten the air gap;

a holder and a joint, wherein the plunger is directly or indirectly connected to the holder; and the joint is disposed on the side opposite to the air gap;

a movable contact fixed in the holder; and a pinion, wherein the joint is indirectly connected to a connection rod and moves the pinion in accordance with a movement of the plunger during a switching operation.

2. The magnet switch for a starter according to claim 1, wherein the movable contact and the joint are disposed oppositely, to each other, across the side wall of the case, and wherein the magnet switch further comprises:

a flange, fixed to the plunger, substantially covers the outer periphery of the case, wherein the flange, the movable contact, the joint and the plunger are connected to each other.

3. The magnet switch for a starter according to claim 1, wherein the plunger has a flange and the joint at its end on the side opposite to the air gap, the flange has an arm which substantially covers the case, and is connected to the holder via the arm, the movable contact on the side opposite to the flange across the case is fixed by the holder substantially from the outside, and a fixed contact is disposed in a position facing the movable contact.

4. The magnet switch for a starter according to claim 1, wherein the case is fastened to the starter with a band or the like and the outer face of the magnet switch is covered with a cover.

5. The magnet switch for a starter according to claim 1, further comprising:

a gear reduction mechanism;

an output shaft for driving the gear reduction mechanism;

an armature shaft, wherein the gear reduction mechanism is installed between the armature shaft and the output shaft and wherein the gear reduction mechanism transmits a reduced number of rotations of the armature shaft to the output shaft;

a connection part for reducing rotation of the pinion, wherein the movable contact contacts the fixed contact to activate the starter motor, and wherein the magnet switch is disposed at a first end of the starter motor and the pinion is disposed at a second end, and wherein the connection part moves in accordance with the plunger that is moved by the attraction coil.

6. A magnet switch for starter, for providing an electric current to a starter motor, having an attraction coil of a substantially cylindrical shape;

wherein an inner face and a side face of the attraction coil are covered with a fixed iron core and sidewalls, while an outer face thereof includes a cylindrical part, a plunger, and an air gap;

wherein the fixed iron core, the sidewalls, the cylindrical part, the plunger and the air gap form a magnetic circuit;

wherein the plunger can move to an opposite side of the cylindrical part, pulled by the attraction coil to shorten the air gap, the plunger being directly or indirectly connected to a holder and a joint on the side opposite to the air gap;

wherein a movable contact is fixed in the holder; and wherein the joint is connected to a pinion indirectly via a connection means, and moves the pinion in accordance with the movement of the plunger during a switching operation.

7. The magnet switch for a starter according to claim 6, wherein:

the movable contact and the joint are disposed on opposite sides to each other across the side walls covering the attraction coil;

a flange fixed to the plunger covers most of the outer periphery of the cylindrical part; and the flange, the movable contact, the joint, and the plunger are connected to each other.

8. The magnet switch for a starter according to claim 6, wherein:

the plunger has the flange and the joint;

the holder covers most of the cylindrical part and its one end is connected to the flange;

the joint is fastened to one end of the plunger;

the movable contact is disposed across the attraction coil on the side opposite the joint;

the movable contact is fixed by the holder; and a fixed contact is disposed in a position facing the movable contact.

9. The magnet switch for a starter according to claim 6, wherein an immovable part of the magnet switch is fastened to the starter with a band or the like and the outer face of the magnet switch is covered with a cover.

10. The magnet switch for starter according to claim 6, comprising an output shaft and a gear reduction mechanism that is installed between an armature shaft of the starter motor and the output shaft and transmits rotation of the armature shaft to the output shaft by reducing a rotation speed, the magnet switch restricting rotation of the pinion via connection means that moves in combination with the plunger, pulled by the attraction coil, the magnet switch activating the pinion by moving the movable contact to contact the fixed contact to activate the starter motor, wherein the magnet switch is disposed on the opposite side of the starter motor as the pinion.

* * * * *